US007670156B2

(12) United States Patent
Chen

(10) Patent No.: US 7,670,156 B2
(45) Date of Patent: Mar. 2, 2010

(54) ELECTRICAL CONNECTOR

(75) Inventor: Wan-Tien Chen, Taipei (TW)

(73) Assignee: Wonten Technology Co., Ltd., Taipei (TW)

( * ) Notice: Subject to any disclaimer, the term of this patent is extended or adjusted under 35 U.S.C. 154(b) by 0 days.

(21) Appl. No.: 12/272,203

(22) Filed: Nov. 17, 2008

(65) Prior Publication Data

US 2009/0163071 A1 Jun. 25, 2009

(30) Foreign Application Priority Data

Nov. 16, 2007 (TW) ..... 096219370

(51) Int. Cl.
*H01R 13/648* (2006.01)

(52) U.S. Cl. ..... 439/108; 439/607.34; 439/607.05

(58) Field of Classification Search ..... 439/108, 439/607.34, 607.05, 607.01
See application file for complete search history.

(56) References Cited

U.S. PATENT DOCUMENTS 4,824,383 A * 4/1989 Lemke ..... 439/108
5,057,028 A * 10/1991 Lemke et al. ..... 439/101
5,169,324 A * 12/1992 Lemke et al. ..... 439/101
5,507,655 A * 4/1996 Goerlich ..... 439/108
6,666,696 B1 * 12/2003 Wu ..... 439/108
7,008,267 B2 * 3/2006 Fan ..... 439/607.35
7,179,127 B2 * 2/2007 Shiu ..... 439/607.35

* cited by examiner

*Primary Examiner*—Gary F. Paumen
(74) *Attorney, Agent, or Firm*—Guice Patents PLLC

(57) ABSTRACT

The present invention relates to an electrical connector, comprises a housing; a base body having a tongue piece, one surface of the tongue piece is provided with a plurality of first terminal slots, the other surface of the tongue piece is provided with a plurality of second terminal slots, and a gap is provided in the middle portion of the tongue piece; a first terminal assembly respectively received in the first terminal slots; a second terminal assembly respectively received in the second terminal slots; and a grounding piece inserted in the gap of the tongue piece, a contact portion is provided by extending from the end of the grounding piece, when assembly the contact portion is in contact with a grounding terminal of any said terminal assemblies mentioned above, so effects of grounding and prevention of static electricity can be achieved.

16 Claims, 5 Drawing Sheets

ELECTRICAL CONNECTOR

BACKGROUND OF THE INVENTION

1. Field of the Invention

The present invention relates to an electrical connector, more particularly to an electrical connector having a compact grounding structure.

2. Description of Related Art

Conventional electrical connectors, e.g., but not limited to, USB, SATA or e-SATA, generally achieve grounding by connecting a grounding terminal of an insulation housing to a metal housing of the connector. Taiwan Utility Patent Number 095221982, Taiwan Utility Patent Number 095201553, Taiwan Utility Patent Number 095201362 and Taiwan Utility Patent Number 095212401 have disclosed the above mentioned structure. For instance, the electrical connector provided by Taiwan Utility Patent Number 095221982 includes a metal piece, the metal piece has a stopping piece, two arm sections, two locking hooks and two tabs. In assembly, a metal housing is sleeved on an outer side of an insulation main body, each extending piece of the base wall of the metal housing passes through each through hole provided on a base portion of the metal housing then the extending pieces are in contact with the tabs of the metal piece so as to achieve grounding. The designs of the patents mentioned above are complicated in structure and inconvenient in assembly, so a novel electrical connector shall be invented to overcome above mentioned disadvantages.

SUMMARY OF THE INVENTION

One object of the present invention is to provide an electrical connector, wherein a ground piece is inserted to a tongue piece of a base body of the electrical connector for enhancing the strength of the tongue piece.

Another object of the present invention is to provide an electrical connector, wherein a ground piece is inserted to a tongue piece of a base body of the electrical connector for increasing grounding effect.

Another one object of the present invention is to provide an electrical connector, wherein a ground piece is inserted to a tongue piece of a base body of the electrical connector for increasing electrical characteristic so as to effectively prevent generation of static electricity The electrical connector provided by the present invention mainly includes a housing having a receiving space; a base body received in the receiving space and having a tongue piece, one surface of the tongue piece is provided with a plurality of first terminal slots, the other surface of the tongue piece is provided with a plurality of second terminal slots, and a gap is provided in the middle portion of the tongue piece; a first terminal assembly having a plurality of first terminals respectively received in the first terminal slots, and the first terminals include a grounding terminal and a signal terminal; a second terminal assembly having a plurality of second terminals respectively received in the second terminal slots, and the second terminals include a grounding terminal, a signal terminal and a power terminal; and a ground piece received in the gap of the tongue piece, a contact portion is extended from the end of the ground piece, in assembly the contact portion is in contact with the grounding terminal of either terminal assemblies mentioned above so as to achieve effects of grounding and prevention of static electricity.

DETAILED DESCRIPTION OF THE PREFERRED EMBODIMENT

Figure 1:
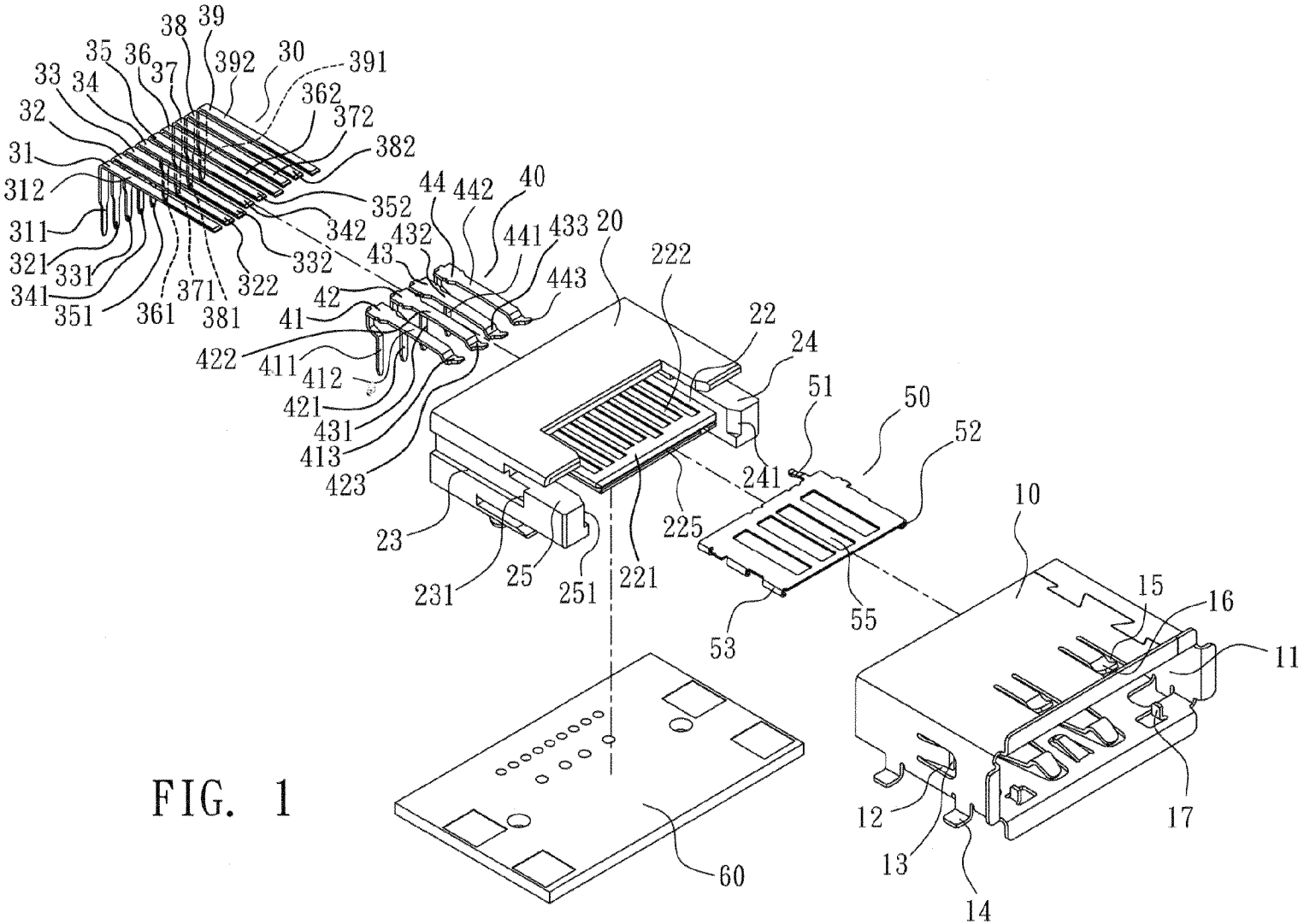
FIG. 1 is an exploded view of an electrical connector of one of the preferred embodiments of the present invention.
Figure 2A:
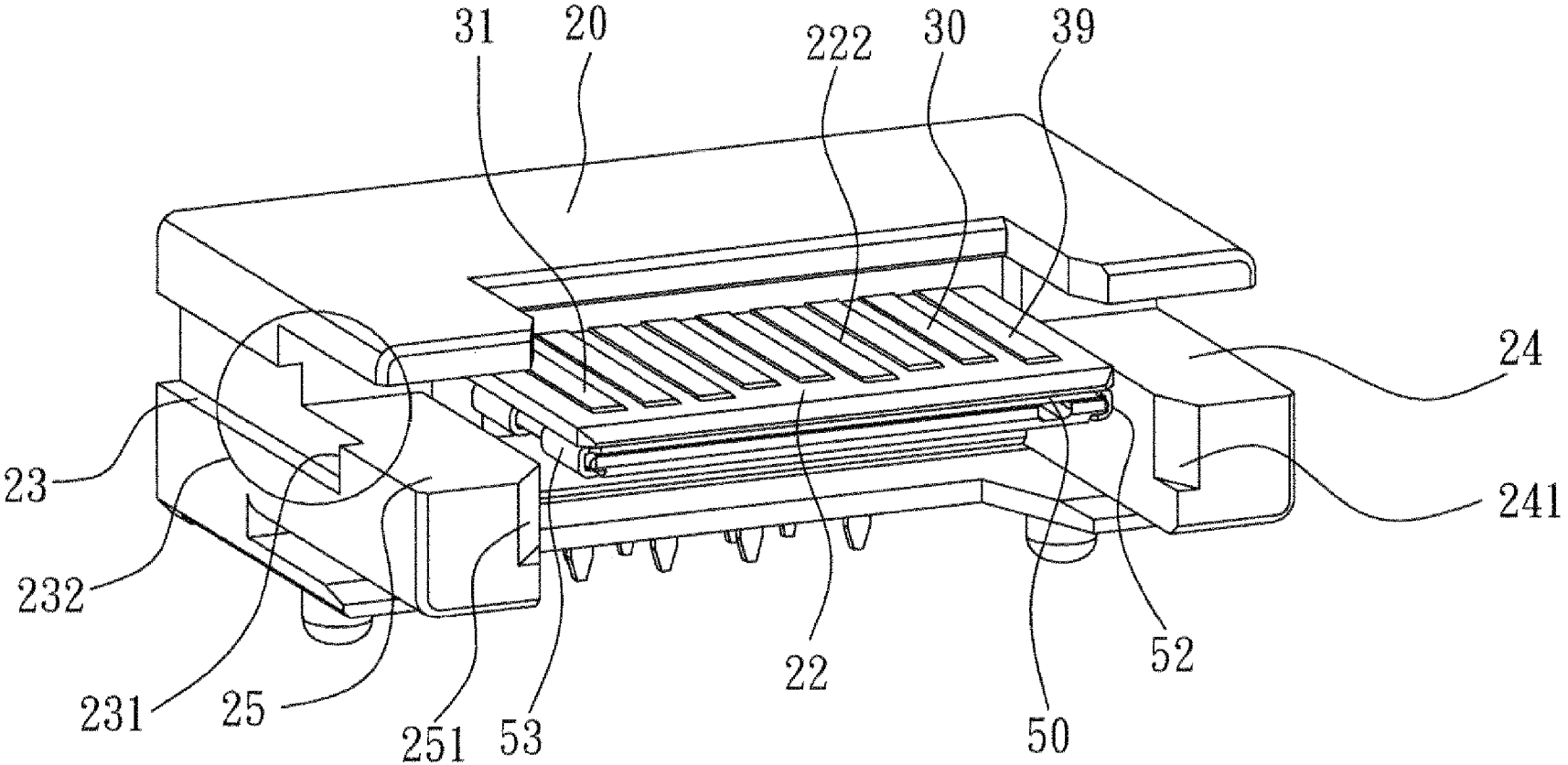
FIG. 2*a* is a front view of a base body of the present invention after being assembled with a first terminal assembly and a second terminal assembly.
Figure 2B:
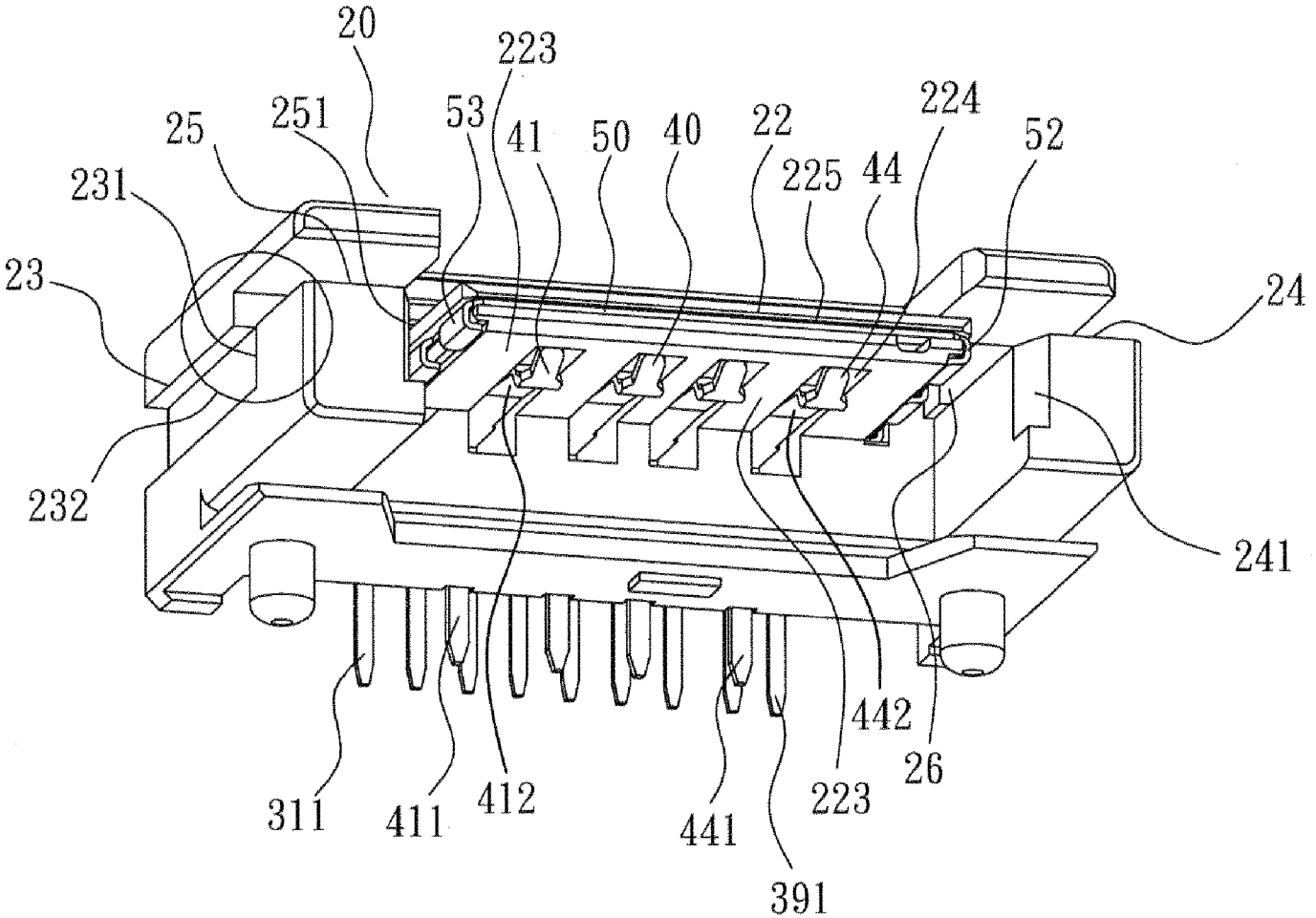
FIG. 2*b* is a bottom view of the base body of the present invention after being assembled with the first terminal assembly and the second terminal assembly.
Figure 3:
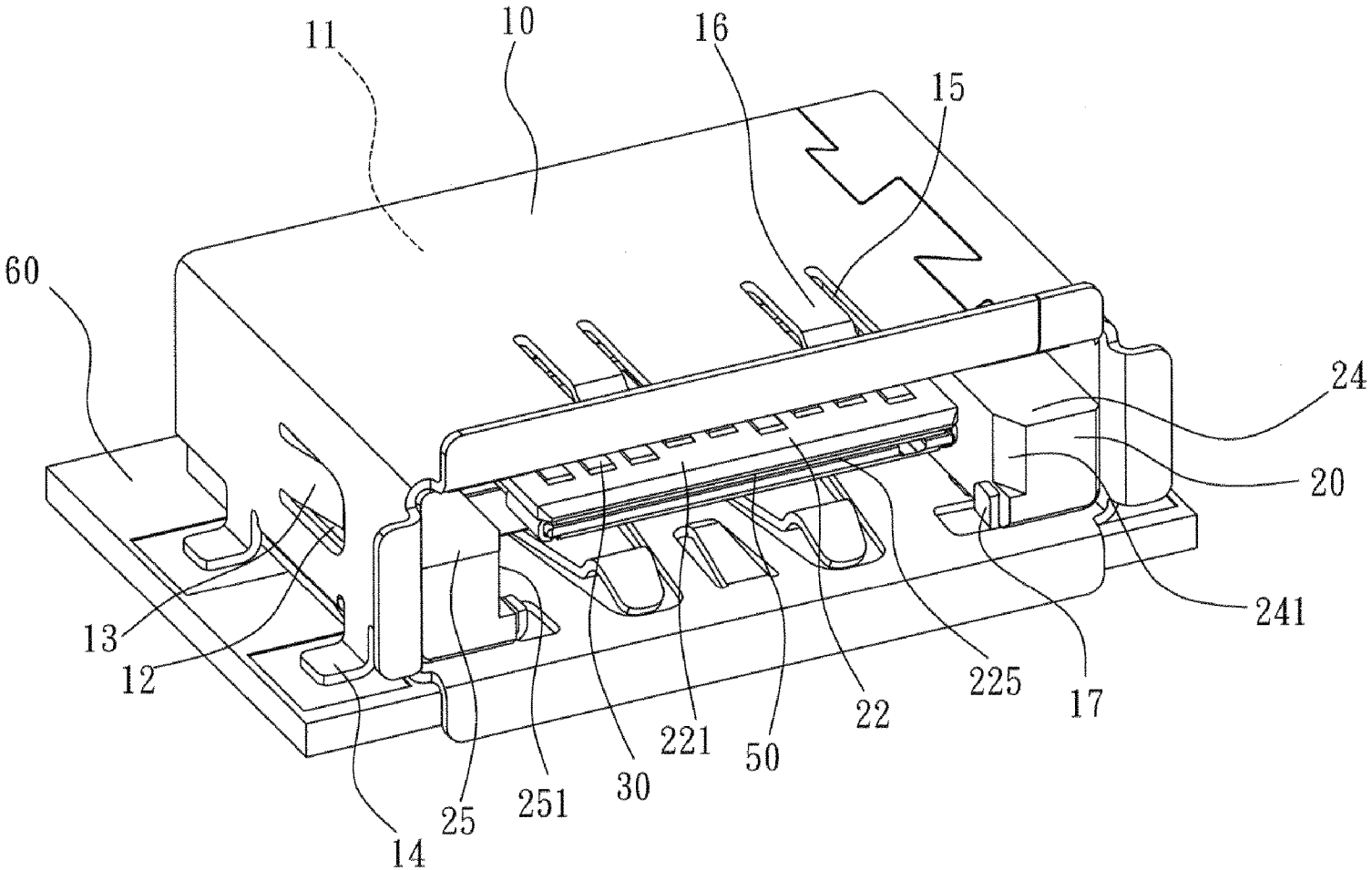
FIG. 3 is a schematic view of the assembly of the electrical connector of one of the preferred embodiments of the present invention.
Figure 4:
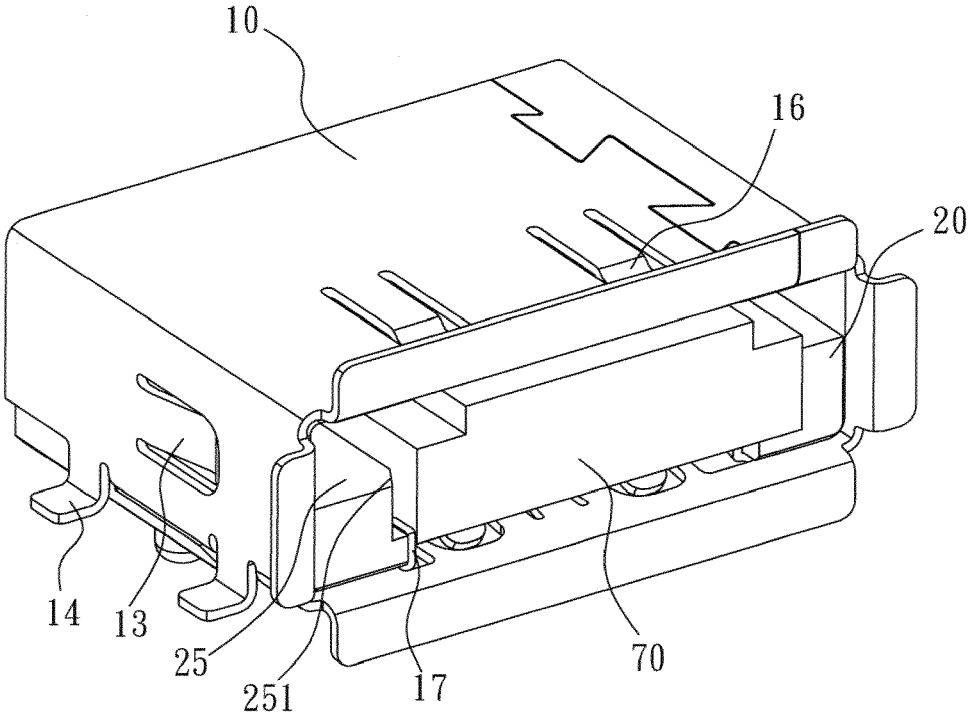
FIG. 4 is a schematic view of the electrical connector of the present invention assembling with an e-SATA connector.
Figure 5:
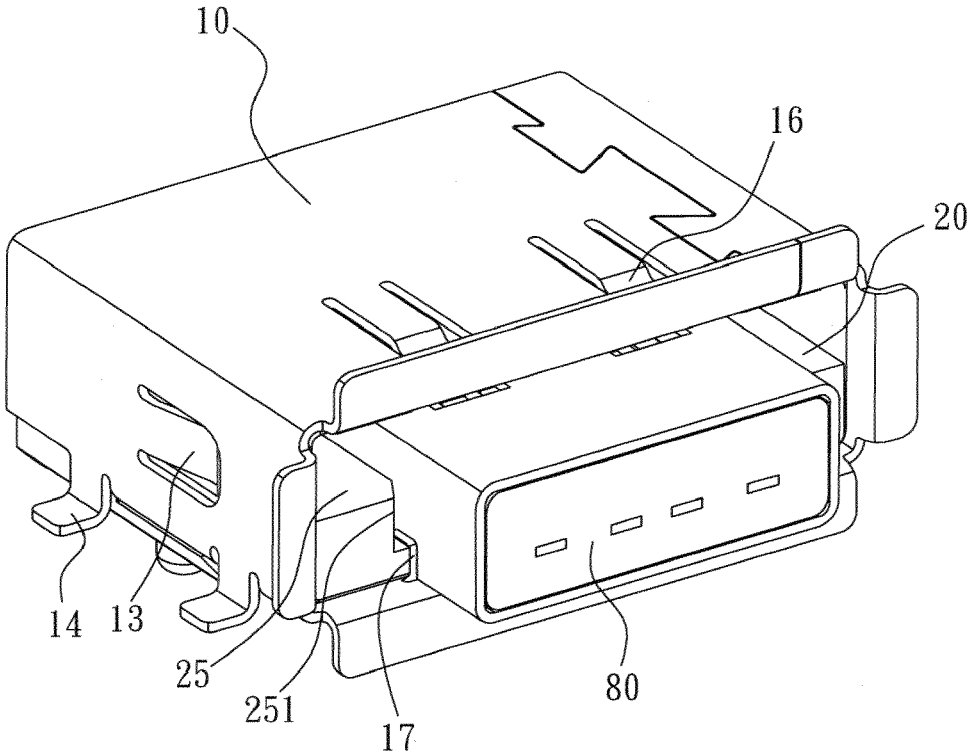
FIG. 5 is a schematic view of the electrical connector of the present invention assembling with an USB connector.

Referring to FIG. 1 to FIG. 5, wherein FIG. 1 is an exploded view of an electrical connector of one of the preferred embodiments of the present invention; FIG. 2*a* is a front view of a base body of the present invention after being assembled with a first terminal assembly and a second terminal assembly; FIG. 2*b* is a bottom view of the base body of the present invention after being assembled with the first terminal assembly and the second terminal assembly; FIG. 3 is a schematic view of the assembly of the electrical connector of one of the preferred embodiments of the present invention; FIG. 4 is a schematic view of the electrical connector of the present invention assembling with an e-SATA connector; FIG. 5 is a schematic view of the electrical connector of the present invention assembling with an USB connector.

As shown in figures, the electrical connector provided by the present invention comprise, a housing 10; a base body 20; a first terminal assembly 30; a second terminal assembly 40; and a ground piece 50.

The housing 10 is provided with a receiving space 11. Materials used to make the housing 10 can be, but not limited to, metal material which is generally used for making conventional electrical connectors. Two lateral walls of the housing 10 are respectively provided with a first opening 12 having a retaining portion 13 that bends inwardly. The base of the two lateral walls of the housing 10 is further provided with at least one welding piece 14. The welding piece 14 is served to be attached to a printed circuit board 60 for enhancing retaining effect. A top wall and a bottom wall of the housing 10 are respectively provided with a second opening 15 having a resilient ground finger 16. The right and the left ends of the bottom wall of the housing 10 are respectively provided with a restricting piece 17.

The base body 20 that is preferably made of insulation material is received in the receiving space 11, and the base body 20 has a tongue piece 22, one surface 221 of the tongue piece 22 is provided with a plurality of first terminal slots 222, the other surface 223 of the tongue piece 22 is provided with a plurality of second terminal slots 224, and a gap 225 is provided in the middle portion of the tongue piece 22; wherein the first terminal slots 222 are not limited to be provided on the top surface 221 of the tongue piece 22, the second terminal slots 224 are not limited to be provided on the bottom surface 223 of the tongue piece 22. Two lateral ends of the base body 20 are respectively provided with a guide slot 23, one end of the guide slot 23 has a stopper 231, and the retaining portion 13 is guided by the guide slot 23 for retaining at the stopper 231. A restricting portion 232 is formed on the guide slot 23 and near the stopper 231, the restricting portion 232 is served to receive the retaining portion 13 and also prevent the retaining portion 13 from moving backwardly.

The first terminal assembly 30, e.g. but not limited to, an e-SATA terminal assembly, is provided with a plurality of first terminals 31~39 respectively received in the first terminal slots 222, and the terminals 31, 32, 33, 36 and 39 of the first terminals 31~39 are arranged in a top-bottom staggered manner with respect to the other terminals 34, 35, 37 and 38, wherein the first terminals 32, 33, 36 and 39 disposed on top can be, but not limited to, grounding terminals, the first terminals 31 can be, but not limited to, power terminals, the first terminals 34, 35, 37 and 38 disposed at bottom can be, but not limited to, signal terminals, so that the e-SATA terminal assembly provided by the present invention can provide electrical power which can not be provided by conventional e-SATA connectors. The first terminals 31~39 are further respectively provided with pins 311~391 and contact portions 312~392 substantially vertical to the pins 311~391. Any side of the first terminal assembly 30 can be further provided with a pair of power terminals (not shown in figures).

The second terminal assembly 40 can be, but not limited to, an USB terminal assembly, the second terminal assembly 40 is provided with a plurality of second terminals 41~44 respectively received in the second terminal slots 224, the second terminals 41~44 includes a grounding terminal which is, e.g., but not limited to, the second terminal 44 and a signal terminal and a power terminal, and the second terminals 41~44 are further respectively provided with pins 411~441 and contact portions 412~442 substantially vertical to the pins 411~441 then bending downwardly, and the other ends of the contact portions 412~442 bend upwardly so stopping portions 413~443 are formed, and the pins 411~441 of the second terminal 40 are disposed at inner side of the pins 311~391 of the first terminals 31~39 and parallel to each other.

The ground piece 50 is inserted in the gap 225 of the tongue piece 22, the end of the ground piece 50, e.g., but not limited to the front right end, is provided with a contact portion 51 extending downwardly, the contact portion 51 is, in assembly, in contact with the grounding terminal 39 of the first terminals 31~39 or the grounding terminal 44 of the second terminals 41~44, so effects of grounding and prevention of Electrostatic Discharge (ESD) can be achieved. Two lateral sides of the ground piece 50 are further provided with at least one inserting edges 52, 53 that can be sleeved on the two lateral sides of the tongue piece 22, the ground piece 50 is therefore held on the tongue piece 22. Plural through holes 55 can be provided on the ground piece 50 so as to save the material used to make the ground piece 50.

Preferring to FIG. 2*a,* after the base body 20 of the present invention is assembled with the first terminal assembly 30 and the second terminal assembly 40, each of the first terminals 31~39 of the first terminal assembly 30 is respectively received in the first terminal slots 222, and the contact portions 312~392 vertically and downwardly extend and expose to outside from the rear end of the housing 10. The base body 20 is respectively provided with steps 24, 25 at the two lateral sides of the tongue piece 22, and front end of each of the steps 24, 25 has chamfers 241, 251 for providing functions of guiding and position limiting.

Referring to FIG. 2*b,* after the base body 20 of the present invention is assembled with the first terminal assembly 30 and the second terminal assembly 40, each of the second terminals 41~44 of the second terminal assembly 40 is respectively received in the second terminal slots 224, and the contact portions 412~442 vertically and downwardly extend and expose to outside from the rear end of the housing 10 and the contact portions 412~442 are disposed at the inner side of the contact portions 312~392. A protruding portion 26 is outwardly extended from the inner side of the step 24, so when a USB plug is inserted, a function of position limiting can be provided.

Referring to FIG. 3, in the assembly of the electrical connector provided by the present invention, the first terminal assembly 30 and the second terminal assembly 40 are firstly assembled in the base body 20; then the ground piece 50 is inserted in the gap 225 of the tongue piece 22; lastly the base body 20 is provided in the receiving space 11 of the housing 10 in a rear-to-front direction, the step 24 is limited and positioned by the restricting piece 17, so the assembly of the electrical connector of the present invention is complete, then the electrical connector provided by the present invention is attached to the printed circuit board 60 via the welding piece 14.

Referring to FIG. 4, when an e-SATA plug is inserted in the electrical connector of the present invention, the e-SATA plug 70 is inserted in the upper half portion of the base body 20, with the shape of the base body 20 and the e-SATA plug 70 engaging with each other the e-SATA plug 70 is retained in the base body 20, and the terminals (not shown in figures) of the e-SATA plug 70 are in contact with the first terminals 31~39 of the first terminal assembly 30, the contact portion 51 of the ground piece 50 is in contact with the grounding terminal 39 so as to achieve effects of grounding and prevention of static electricity.

Referring to FIG. 5, when an USB plug 80 is inserted in the electrical connector of the present invention, the USB plug 80 is inserted on the lower half portion of the base body 20; with the step 24, the protruding portion 26 and the restricting piece 17 of the base body 20 the USB plug 80 is retained in the base body 20, and the terminals (not shown in figures) of the USB plug 80 are in contact with the second terminals 41~44 of the second terminal assembly 40, and the contact portion 51 of the ground piece 50 is in contact with the grounding terminal 44 so as to achieve effects of grounding and prevention of static electricity.

It is to be understood, however, that even though numerous characteristics and advantages of the present embodiments have been assembly forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprises:

a housing having a receiving space;

a base body received in the receiving space and having a tongue piece, one surface of the tongue piece is provided with a plurality of first terminal slots, the other surface of the tongue piece is provided with a plurality of second terminal slots, and a gap is provided in the middle portion of the tongue piece;

a first terminal assembly having a plurality of first terminals respectively received in the first terminal slots, and the first terminals include a grounding terminal and a signal terminal;

a second terminal assembly having a plurality of second terminals respectively received in the second terminal slots, and the second terminals include a grounding terminal, a signal terminal and a power terminal; and a ground piece received in the gap of the tongue piece, a contact portion is extended from the end section of the ground piece, in assembly the contact portion is in contact with the grounding terminal of either terminal assemblies mentioned above so as to achieve effects of grounding and prevention of static electricity.

2. The electrical connector as claimed in claim 1, wherein the housing is made of metal material, and two walls thereof are respectively provided with a first opening having a retaining portion that bends inwardly.

3. The electrical connector as claimed in claim 2, wherein two ends of the base body are respectively provided with a guide slot, one end of the guide slot has a stopper, and the retaining portion is guided by the guide slot for retaining at the stopper.

4. The electrical connector as claimed in claim 3, wherein a restricting portion is formed on the guide slot and near the stopper, the restricting portion is served to receive the retaining portion and also prevent the retaining portion from moving backwardly.

5. The electrical connector as claimed in claim 1, wherein the base of the two lateral walls of the housing is further provided with at least one welding piece, the welding piece is served to be attached to a printed circuit board for enhancing retaining effect.

6. The electrical connector as claimed in claim 1, wherein the first terminal assembly is an e-SATA terminal assembly, and a plurality of the first terminals are arranged in a top-bottom staggered manner with respect to the other terminals.

7. The electrical connector as claimed in claim 5, wherein any side of the first terminal assembly disposed on top is provided with a pair of power terminals.

8. The electrical connector as claimed in claim 6, wherein the first terminals are further provided with pins and contact portions substantially vertical to the pins.

9. The electrical connector as claimed in claim 8, wherein the second terminal assembly is an USB terminal assembly, the second terminals are further respectively provided with pins and contact portions substantially vertical to the pins then bending downwardly, and the other ends of the contact portions bend upwardly so stopping portions are formed, and the pins of the second terminals are disposed at the inner side of the pins of the first terminals and parallel to each other.

10. The electrical connector as claimed in claim 1, wherein the contact portion is at the front right end of the ground piece.

11. The electrical connector as claimed in claim 1, wherein two sides of the ground piece are further provided with inserting edges sleeved on the two sides of the tongue piece.

12. The electrical connector as claimed in claim 1, wherein a top wall and a bottom wall of the housing are respectively provided with a second opening having a resilient ground finger.

13. The electrical connector as claimed in claim 1, wherein the base body is respectively provided with a step at the two lateral sides of the tongue piece, and one front end of each steps has a chamfer for providing functions of guiding and restricting.

14. The electrical connector as claimed in claim 13, wherein the right and left ends of the bottom wall of the housing are respectively provided with a restricting piece for restricting and positioning the step.

15. The electrical connector as claimed in claim 13, wherein a protruding portion is outwardly extended from the inner side of the step, so when an USB plug is inserted, a function of restricting is provided.

16. The electrical connector as claimed in claim 12, wherein the first terminal slots are on the top surface of the tongue piece and the second terminal slots are on the bottom surface of the tongue piece.

* * * * *